United States Patent [19]

Sherman

[11] Patent Number: 4,932,720

[45] Date of Patent: Jun. 12, 1990

[54] MODULAR FURNITURE SYSTEM

[76] Inventor: Ronald K. Sherman, 1901 W. Copans Rd., Pompano Beach, Fla. 33064

[21] Appl. No.: 270,671

[22] Filed: Nov. 14, 1988

[51] Int. Cl.[5] ..... A47C 4/00

[52] U.S. Cl. ..... 297/440; 297/443

[58] Field of Search ..... 297/440, 442, 444

[56] References Cited

U.S. PATENT DOCUMENTS

| | | | |
|---|---|---|---|
| 3,104,913 | 9/1963 | Faulkner et al. | 297/440 X |
| 3,171,690 | 3/1965 | Weiss | 297/440 |
| 3,525,549 | 8/1970 | Knabusch et al. | 297/440 X |
| 3,608,959 | 9/1971 | Sarvas | 297/440 X |
| 4,188,066 | 2/1980 | Terenzoni | 297/440 |
| 4,395,071 | 7/1983 | Laird | 297/440 |
| 4,523,787 | 6/1985 | Robinson | 297/440 |

FOREIGN PATENT DOCUMENTS

| | | | |
|---|---|---|---|
| 1479158 | 7/1977 | United Kingdom | 297/442 |
| 2040159 | 8/1980 | United Kingdom | 297/440 |

*Primary Examiner*—Peter R. Brown

*Attorney, Agent, or Firm*—Melvin K. Silverman

[57] ABSTRACT

A modular sofa system provided with a perimetric horizontal frame having horizontally projecting lip elements. The frame is provided with brackets at opposite transverse ends thereof which are secured integrally with the lip elements. Further provided are front and rear horizontal beams which are complementally secured at opposite ends thereof by the brackets and associated lip elements. A hollow removable back module is provided which includes, at opposite transverse ends thereof, back module templets which are proportioned for complemental receipt within the bracket means of the frame. Further provided is a removable seat module which is positioned upon said horizontal beams. The back and seat modules may be easily removed and interchanged with other respective back and seat modules. Also, by virture of removeability of the back module from the system, the area at which the fabric covering the back module is secured, may be easily accessed for purposes of removal of such fabric. A substantial savings in the quantity of fabric and the labor associated with the securement of such fabric to the sofa system is achieved.

7 Claims, 3 Drawing Sheets

MODULAR FURNITURE SYSTEM

BACKGROUND OF THE INVENTION

The present invention relates to a method and structure of furniture construction and, more particularly, relates to a method of furniture construction in which certain of the elements thereof are modular in order to thereby permit ease of change or removal of the fabric of the back and/or other elements thereof.

In the prior art, the change or removal of upholstery from a sofa, sofa-bed, loveseat, sofa-chair, and the like has constituted a difficult, expensive, and time consuming process such that the typical cost of re-upholstering a sofa or sofa-bed has been in the range of $700 to $900. Therefore, as a practical matter, sofas, sofa-beds, and the like, are rarely re-upholstered, the reason simply being that the cost of re-upholstering comprises a large percent of the cost of replacing the sofa.

The instant invention addresses this problem through the use of modular back and seat components which are formed in such a fashion to permit ready access to means which hold the fabric in place, and which may be easily removed in order to effect the removal of worn fabric and the replacement thereof by new fabric. Also, the cost of production of a sofa is substantially reduced by the present invention.

While knock-down (so called KD) furniture is known in the art, to the knowledge of the inventor, there does not exist any type of KD, or other, furniture having removable back and seat modules from which the fabric may be readily removed and replaced by different fabric.

SUMMARY OF THE INVENTION

The present invention comprises a horizontal perimetric frame having therein seat module positioning brackets, and back module positioning brackets. Upon said seat module positioning brackets is placed a removeable seat module which may comprise the seat of a sofa, a sofa-bed, a loveseat, or a sofa-seat. Disposed upon said back module positioning means is a hollow, removable back module having, therein, templet means for complementally engaging said back module positioning brackets to define the height and orientation, relative to the floor. The removable back module is a hollow, right solid triangular structure surrounded by padding and, thereupon, fabric. Said fabric is secured at the front and back edges of said hollow back panel through the use of removable securement elements, such as staples. To effect change or removal of the fabric, the fabric securement elements are simply removed.

To convert a sofa into a sofa-bed, or vice-versa, the particular removable seat module is lifted off of said seat module positioning elements and the desired substitute type of seat module is positioned there onto.

Said frame may be formed of metal and will be surrounded with a suitable exterior furniture material such as wicker or rattan which, in one embodiment, may be bolted or screwed to the circumferential horizontal metal frame.

It is thereby seen that an object of the present invention is to provide a modular furniture system in which the seat module and back module thereof may be readily removed for purposes of changing the same or of removing the fabric thereof, for the replacement of such fabric by a new or different fabric.

A further object of the present invention is to provide a furniture system in which the upholstery thereof may be easily and cost effectively applied and/or replaced.

It is another object of the present invention to provide a modular furniture system in which a sofa may be converted into a sofa-bed and vice-versa.

It is yet another object of the present invention to provide a modular furniture system in which different back modules and seat modules may be readily inserted into a standard interchangeable furniture frame.

The above and yet other objects and advantages of the present invention will become apparent in the hereinafter set forth detailed description of the invention, the drawings, and claims appended herewith.

DETAILED DESCRIPTION OF THE INVENTION

Figure 1:
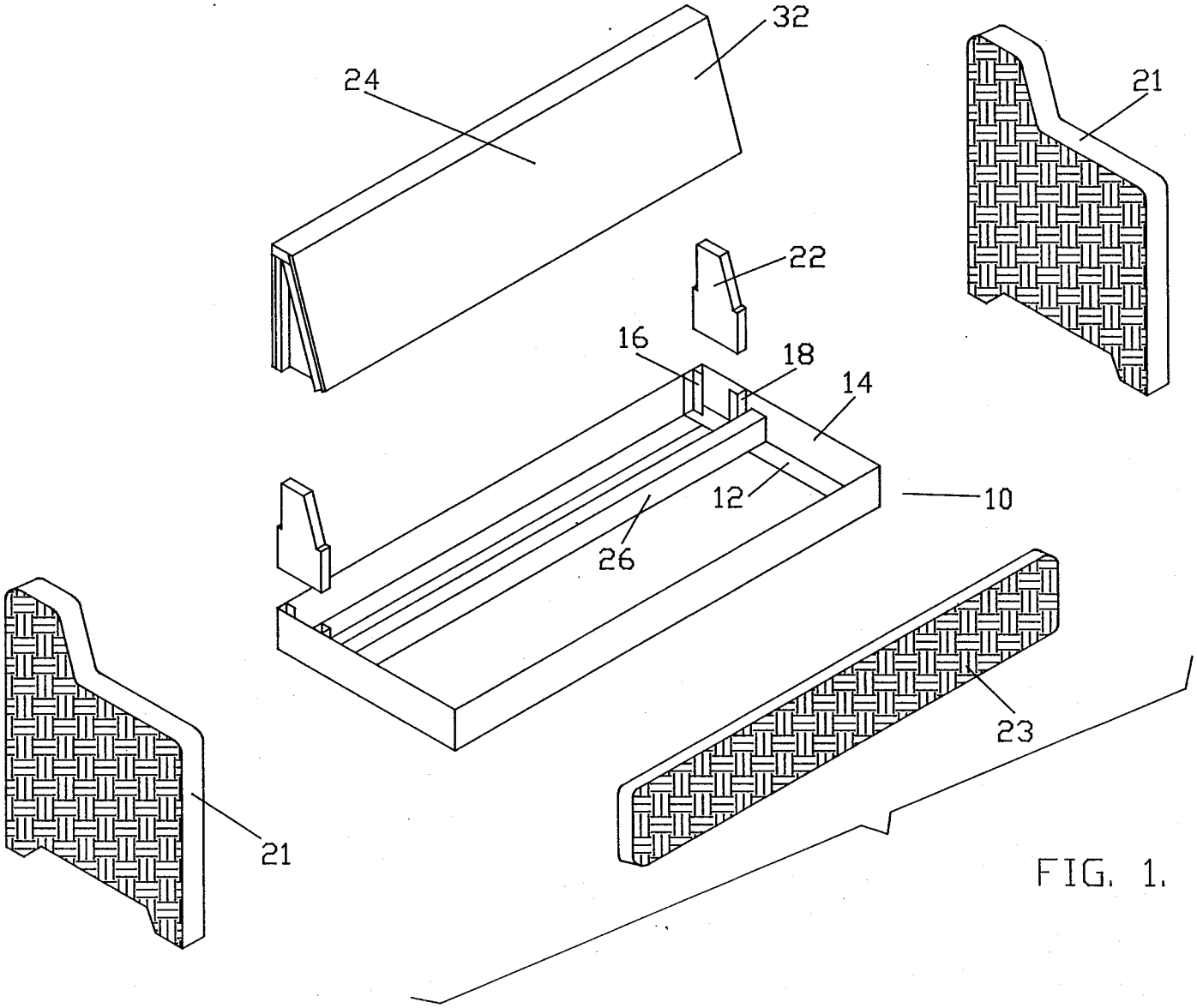
FIG. 1 is an exploded view of the inventive system.

With reference to the exploded view of FIG. 1 and the side view of FIG. 2, the inventive modular furniture system may be seen to include a perimetric metal L-frame 10 which, in the illustrated embodiment, comprises a rectangular frame or support for the below described furniture system. As may be noted, the L-shaped geometry of metal frame 10 provides for horizontal lip elements 12 which extend integrally and perimetrically in the horizontal plane from vertical components 14 of said metal frame 10.

Provided upon the horizontal lip elements 12 of said frame 10 are a number of bracket means which, more particularly, include first bracket means 16, second bracket means 18 and third bracket means 20. The function of said first and second bracket means is to complementally receive and secure back module templets 22 (more fully described below), which comprise the end elements of a hollow, removable back module 24.

A further function of said second bracket means 18 is to complementally secure and position rear seat module support beam 26. Similarly, the function of third bracket means 20 is to complementally engage and support front module support beam 28.

By virtue of the above structure, there is defined a basic unit, consisting of said perimetric frame 10, said bracket means 16, 18 and 20, and said rear and front beams 26 and 28 respectively, from which, as will be set forth below, many different systems may be assembled.

Upon the outside of metal frame 10 may be fastened any one of a variety of types of sofa arms 21 sofa front panels 23 and sofa back panels (not shown). See for example FIG. 1 in which there is illustrated back and front elements which are formed of a wicker or rattan. It is, to be appreciated, that within the scope of the present invention, any type of front, rear, and arm panels may be employed, so long as such panels possess sufficient rigidity to be secured to said perimetric frame 10.

Figures 2, 3:
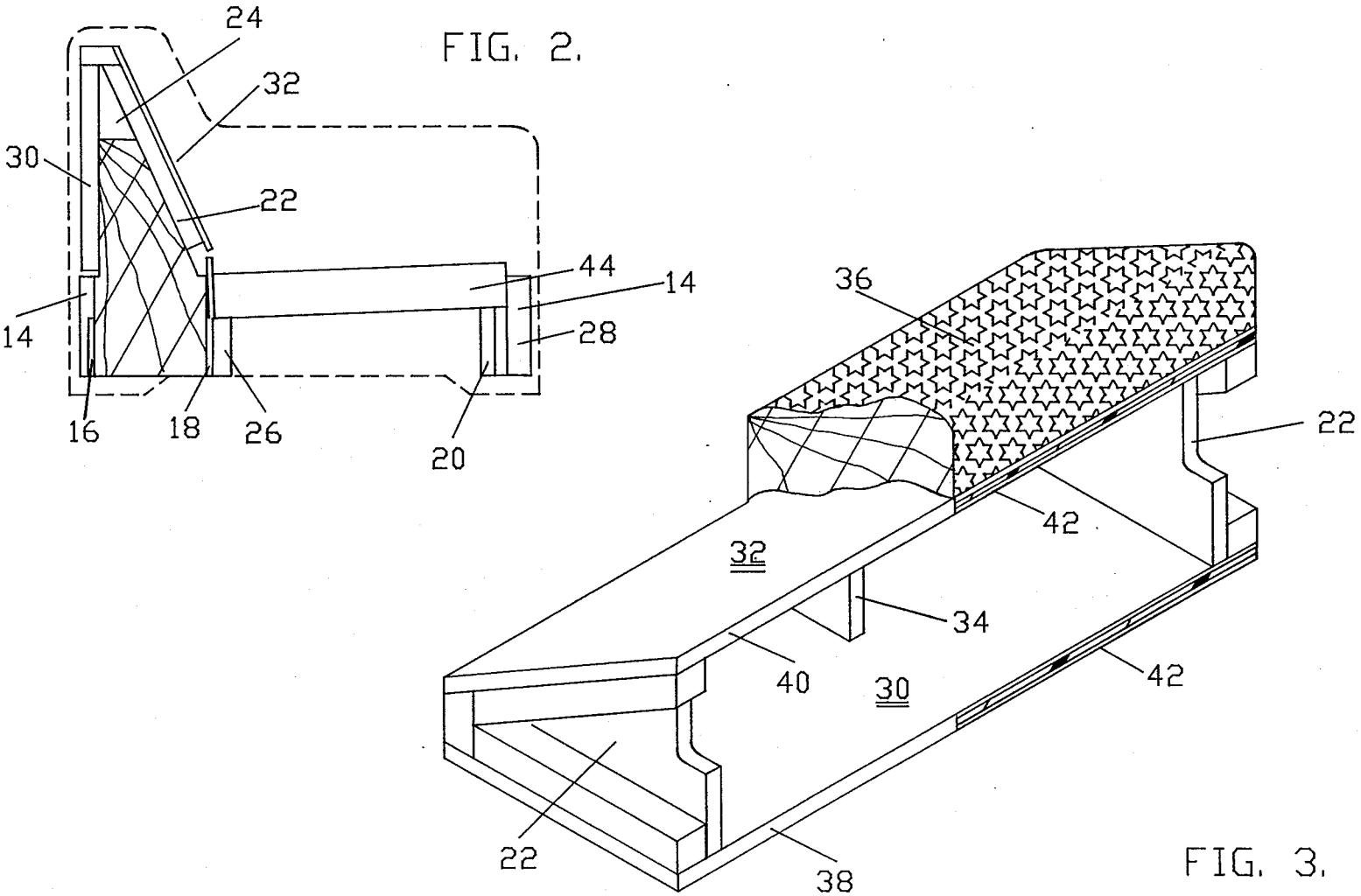
FIG. 2 is a side, schematic assembly view thereof.
FIG. 3 is a perspective view showing the hollow base of the back module.

With reference to the view of FIG. 2, there is shown a removable seat module 44 and said hollow, removable back module 24. Said back module is more fully shown in FIG. 3 in which said back module as seen to comprise a hollow right triangular structure defined, at its bases by said back module templets 22, at its back by planar back element 30, and at its front by-planar front element 32. In the center of the structure there is provided a support element 34. As may be noted from FIGS. 3 and 4, said back and front planar elements 30 and 32 respectively are covered by a layer of appropriate padding and, in turn, are covered by a selected fabric 36. This fabric is secured at the edges 38 and 40 of said planar panels 30 and 32 respectively. Such securement may be in the nature of a extended strip which is stapled to secure fabric 36 to the respective inside lips of said planar back and front panels 30 and 32 respectively. It is to be noted that where one wishes to remove said staples and, thereby, to remove the fabric held thereby, it is merely necessary to pull stripping 42 within which said staples (or like means) have been applied. Upon pulling such stripping 42, the staples will virtually pop out, thereby releasing the fabric 36 with a minimal expenditure of effort. This procedure represents a substantial savings in time verses the time involved in the removal of fabric in prior art structures of the instant type.

It is to be further noted that the back module templets 22 are proportioned to be complementally received by said first and second bracket means 16 and 18, as is above discussed. Accordingly, through the lifting of back module 24 in an upward vertical direction, the back module templets 22 will be released from said bracket means. It may be appreciated that the height and tilt of the back module 24 relative to the floor will be governed primarily by the geometry of said templets 22 of the back module 24. Thereby, back modules having rather different shapes and tilts may be employed by simply modifying the peripheral geometry the templets of a particular back module.

In FIG. 2 there is shown a sofa seat module 44 which rests upon the rear support beam 26 and the front support beam 28. The orientation of the plane of sofa module 44 relative to the floor is controlled through the selection of an appropriate vertical length of beam 28 relative to beam 26. More particularly, in FIG. 2, the vertical length of beam 28 is seen to exceed the vertical length of beam 26. Thereby, sofa seat module 34 will tilt backward, as is conventional in sofa designs.

Figure 5:
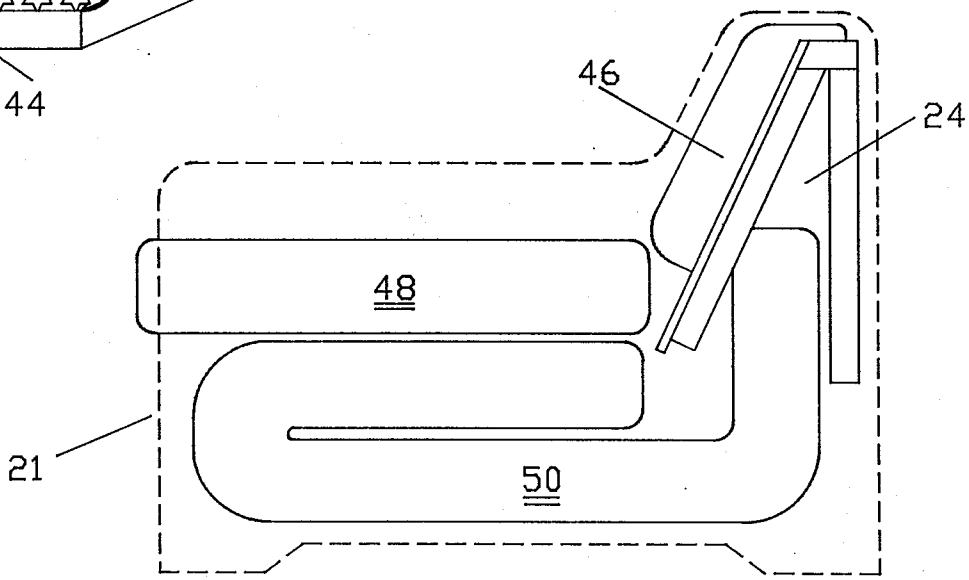
FIG. 5 is a side, schematic assembly view of the sofa-bed embodiment of the invention.

After seat module 44 is put into place, back cushions 46 and seat cushions 48 may be positioned upon the back module 24 and seat module 44 respectively. See FIG. 4.

Where on wishes to employ the system as a sofa-bed, a sofa-bed module 50 (See FIG. 5) is substituted for sofa-seat module 44. Therein, it may be noted that a portion of the sofa-bed module will extend into the hollow region of back module 24. Thusly, without any change in the structure of the foundation/frame assembly, an otherwise conventional sofa may be converted into a sofa-bed or vice-versa. The same principles are equally applicable to sofa chairs and to loveseats.

As a result of the above modular furniture system, several practical advantages are achieved. Most noteworthy among these is that upholstery may be easily removed from the back module 24 and the attachable frame elements 21 and 23 where such frame elements are upholstered. More particularly, by simply removing the stripping 42 and its associated staples, as is discussed with reference to FIG. 3 above, the fabric thereon may be readily removed and, thereafter, new fabric reapplied.

In addition to the above convenience, the quantity of the fabric required to cover a modular system of the present type is about four yards as opposed to the approximately twelve yards of fabric which are used in a conventional 72 inch sofa. Further, not only is a savings effected in the cost of fabric but, as well, the labor costs involved in cutting and applying the fabric is reduced to approximately 1.5 hours, this being only about ten percent of the labor involved in cutting and applying fabric to a typical prior art sofa.

As a consequence of the above advantages, fabric may be more effectively and economically cleaned in that it is only necessary to remove the back module 24. If desired, the fabric can even be removed for purposes of cleaning and then re-stapled into place.

Figure 4:
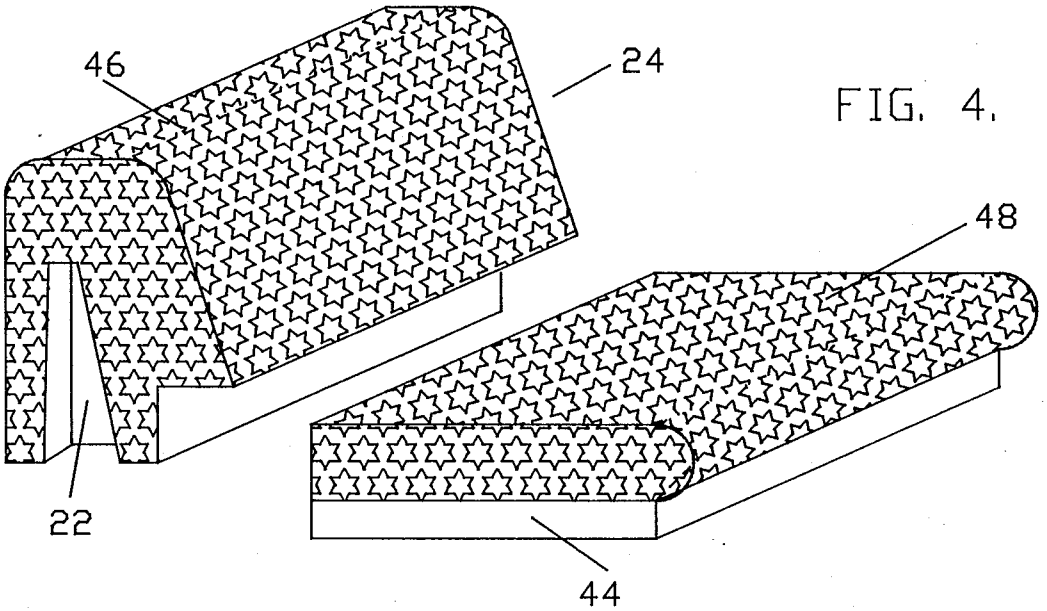
FIG. 4 is a perspective view of the seat and back modules.

In most cases sofa owners will elect to change fabric in view of the drastically reduced re-upholstering costs associated with the instant system. In effect, the present system transforms fabric upholstery into a item which can be readily replaced as may be governed by the interior design requirements of the owner. A further advantage of the above lies in the fact that the cushions 48 covering the seat module may be selectively changed from a plurality of cushions, e.g., three, to the use of a single large cushion occupying the entire length between the end pieces of metal frame 10, as is shown in FIG. 4.

Accordingly, a design conscious owner may easily alternate between the use of several smaller seat cushions and the use of one single large seat cushion, covering the removable seat module 44.

Thusly, there has been shown and described in the third embodiment of the present invention, it is to be appreciated that the invention may be embodied otherwise than is herein specifically illustrated and described and that, within the said embodiment, certain changes may be made without departing from the underlying idea or principles of this invention within the scope of the appended claims.

Having thus described my invention, what I claim as new, useful and non-obvious and, accordingly, secure by Letters Patent of the United States is:

1. A modular furniture system comprising:

(a) a perimetric horizontal frame, having opposite transverse ends consisting of vertical elements and horizontal elements, said horizontal elements comprising horizontally projecting lip elements at the bottom of said vertical elements;

(b) bracket means disposed at said opposite transverse ends of said frame and formed integrally with said horizontally projecting lip elements;

(c) front and rear horizontal beam means complementally, removably secured, at opposite ends thereof, by said bracket means at said opposite transverse ends of said frame;

(d) a hollow, removable back module comprising, at opposite transverse ends thereof, back module templets, said templets proportioned for complemental engagement within said bracket means of said frame, said templets defining the height and angulation, relative to the floor, of said back module; and (e) a removeable seat module positioned upon said beam means.

2. The system as recited in claim 1, further comprising cushion means disposed upon each of said back module and seat module.

3. The system as recited in claim 1, in which said back module comprises:

cushion means secured about the exterior surfaces thereof, and fabric secured over said cushion means, said fabric detachably secured to the edges of a substantially horizontal base of said back module.

4. The system as recited in claim 3 in which said back module comprises means for selectably removing said fabric from said module for purposes of cleaning, replacement, or the like.

5. The system as recited in claim 2, further comprising:

selectably removable sofa arms complementally, detachably secured from said back module and horizontal frame.

6. The system as recited in claim 2, further comprising:

selectably removable sofa front panels complementally secured and detachable from said horizontal frame.

7. The system as recited in claim 2, further comprising:

selectably removable sofa back panels complementally detachably removable from said back module.

* * * * *